United States Patent [19]

Kauk

[11] 4,018,439

[45] Apr. 19, 1977

[54] TRAINING DEVICE FOR ICE SKATERS

[76] Inventor: Reinhold J. Kauk, 442 Biehn Drive, Kitchener, Ontario, Canada, N2G 3W5

[22] Filed: May 7, 1976

[21] Appl. No.: 684,381

[52] U.S. Cl. ..... 272/70.3; 280/87.02 W; 297/5

[51] Int. Cl.[2] ..... A63C 3/04

[58] Field of Search ..... 272/70.3; 297/5, 6; 280/94, 271, 268, 21 R, 87.02 W, 11.37 R, 16

[56] References Cited

UNITED STATES PATENTS

| | | | |
|---|---|---|---|
| 16,862 | 3/1857 | Thomas | 272/70.3 |
| 55,529 | 6/1866 | Pallissard | 272/70.3 |
| 606,525 | 6/1898 | Dunning et al. | 280/271 |
| 899,030 | 9/1908 | Davis | 272/70.3 |
| 905,314 | 12/1908 | Hoard | 280/21 R |
| 2,306,780 | 12/1942 | Copson | 272/70.3 |
| 3,235,254 | 2/1966 | Robson | 272/70.3 |
| 3,350,095 | 10/1967 | Clasen | 272/70.3 |
| 3,352,515 | 11/1967 | Albright | 280/94 X |

FOREIGN PATENTS OR APPLICATIONS

| | | | |
|---|---|---|---|
| 1,270,221 | 6/1968 | Germany | 272/70.3 |

*Primary Examiner*—Paul E. Shapiro
*Attorney, Agent, or Firm*—Joel Halpern

[57] ABSTRACT

A training device for ice skaters includes a body enclosing rectilinear frame and pairs of front and rear support legs depending from the frame. Runners are provided at the lower extremities of the support legs and at least the runners on the rear support legs are rotatable. Springs operatively connect the rotatable runners and their associated support legs such that during the forward movement of the trailing device the rotatable runners are caused to rotate against the bias of their respective springs into an orientation parallel to the direction of movement and when the training device is stationary the rotatable runners are biased by the springs towards an orientation substantially perpendicular to the longitudinal axis of the training device.

6 Claims, 4 Drawing Figures

TRAINING DEVICE FOR ICE SKATERS

BACKGROUND OF THE INVENTION

The present invention relates to training devices for ice skaters and more particularly to a training device for young children which encloses the child and provides support.

Training devices for ice skaters have been known heretofore. U.S. Pat. No. 320,462 issued June 28, 1885 to W. J. Cowing, for example, discloses a skater's appliance which includes an open frame dimensioned to enclose the skater supported by a plurality of uprights having rigidifying bars or runners at their lower extremities. However, the runners of the Cowing device are not constructed in a manner which enables the skater to "push off" from a stationary start and to glide without interference from the runners during forward movement of the appliance. In other words, although the appliance does provide support for the skater it does not afford assistance in getting started from an at rest position. For beginning skaters it is usually difficult to develop sufficient motive force to achieve steady forward motion, the beginning skater generally tending to slip and flounder until such a steady state of forward movement is attained.

SUMMARY OF THE INVENTION

It is one object of the invention to provide a training device for ice skaters which affords support for the skater to assist in the maintenance of the skater's vertical equilibrium and to also afford assistance in attaining a steady state of forward movement from an at rest position.

It is another object of the invention to provide a training device for ice skaters which can be easily assembled and disassembled and which is provided with a runner structure specially adapted to assist the skater in the attainment of a steady state of forward movement from an at rest position.

Other objects and advantages of the invention will become readily apparent from the following description of the invention.

According to the present invention there is provided a training device for ice skaters comprising:

a rectilinear horizontally disposed frame dimensioned to enclose a skater;

a pair of front support legs and a pair of rear support legs extending downwardly from the corners of said frame;

a runner secured to each of said support legs, the runners on at least said pair of rear support legs being rotatably mounted thereon so as to be rotatable through a predetermined arc;

and spring means operatively connecting each of the rotatable runners with their associated support legs, whereby during forward movement of the training device said rotatable runners are caused to rotate against the bias of said spring means into an orientation parallel to the direction of movement and when the training device is at rest said rotatable runners are biased by said springs towards an orientation substantially perpendicular to the longitudinal axis of the training device.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 3:
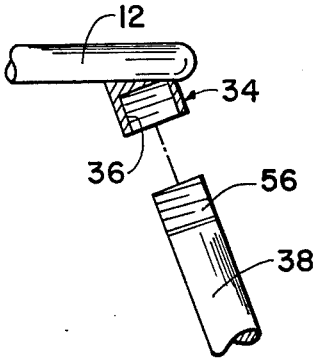
FIG. 3 is an enlarged fragmentary view of the manner of connecting the support legs to the frame.
Figure 1:
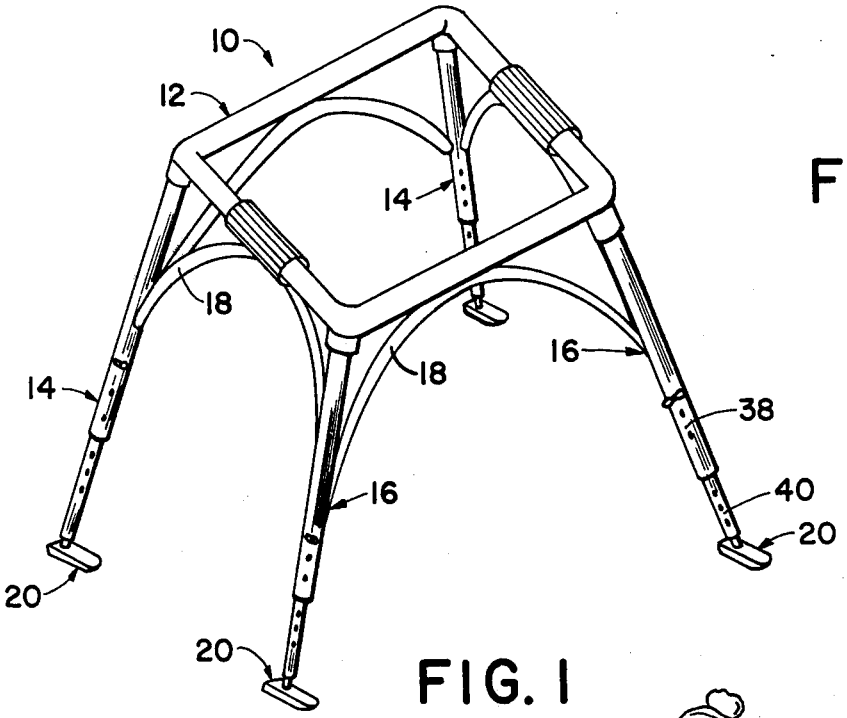
FIG. 1 is a perspective view of a training device for ice skaters embodying the features of the invention.

Referring now to the drawings there is shown generally, as identified by reference numeral 10, a training device for ice skaters.

Figure 2:
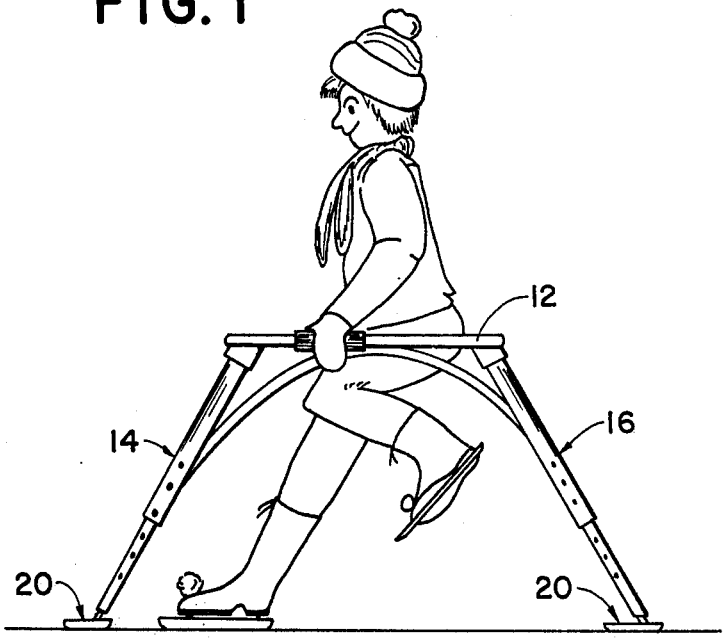
FIG. 2 is a side view of the training device shown in FIG. 1 with a skater within the device.

The training device includes a rectilinear horizontally disposed frame 12 which is desirably, but not essentially, in the form of a square. The frame is dimensioned to enclose a skater as depicted in FIG. 2.

A pair of front support legs 14 and a pair of rear support legs 16 are connected to the corners of the frame and extend downwardly thereof. Preferably the support legs depend in prismoidal fashion to thereby impart greater stability to the structure. Reinforcing members 18 desirably extend between and interconnect adjacent legs to improve the rigidity of the device.

Figure 4:
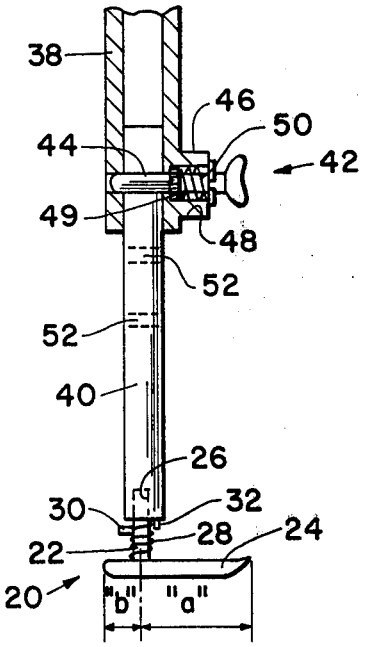
FIG. 4 is a fragmentary elevational view, partly in cross-section, showing the telescoping leg elements and the manner of their interconnection and also showing the construction of the rotatable runners.

A runner 20 is secured to each of the support legs at the lower extremity thereof. The runners on at least the rear support legs are rotatably mounted in such legs for a purpose which will become clear as the description of the invention ensues. As shown most clearly in FIG. 4, the rotatable runners are provided with a shaft 22 extending upwardly from the horizontally disposed blade 24. The lower portion of the support leg is given a blind bore 26 within which the shaft is journaled. A spring 28 is mounted on the shaft and is connected to the support leg so as to exert a biasing force on the runner tending to urge the runner into an orientation generally perpendicular to the longitudinal axis of the training device. Stop members 30, 32 are provided on the runner and on the support leg to limit the extent of rotation of the runner. It will thus be appreciated that when the training device is at rest the runners of at least the rear support legs will be spring-biased into an orientation such that they will exert a rearward force against the ice and thereby assist the skater in pushing off from an at rest position. It will be further understood that due to the rotatable mounting of the runners as the device moves forwardly on the ice the frictional force on the blade will urge the blade into an orientation such that it is disposed parallel to the direction of movement of the device. The rotational movement against the biasing force of the spring is facilitated by mounting the runner in the support leg such that it is rotatable about a vertical axis which is offset from the mid-point of the runner. This may be accomplished by attaching the blade to the shaft of the runner at a location closer to one end of the blade than the other as can be seen in FIG. 4. A greater frictional force will thus develop across section *a* of the blade than across section *b* and the result will be a rotation of the runner against the bias of the spring into its disposition aligned with the direction of movement of the training device.

To facilitate assembly and disassembly of the training device so as to enhance the portability of the device the support legs are constructed so as to be separable from the frame. Thus, the frame is given a depending pipe flange 34 at each of its corners. The lower section of each such pipe flange is threaded as at 36.

Each of the support legs comprises upper and lower telescoping leg elements 38, 40. The leg elements are releasably interconnected by means of a locking member 42. The locking member includes a locking pin 44 which extends through and is supported within a boss 46 on the upper leg element having a bore 48 therein. A spring 50 is mounted within bore 48 so as to bear against an annular collar 49 on the locking pin and thereby bias the locking pin into its locking position. A series of vertically spaced apertures 52 are formed in the lower leg element, the apertures being dimensioned to receive the locking pin. Thus, shifting of the lower leg element 40 within the upper leg element until the locking pin is urged into one of apertures results in a locking of the leg elements in a selected position thereby establishing the elevation of the frame 12 above the surface of the ice 54 to accommodate the device to the height of the skater.

The upper portions of the upper leg elements 38 are threaded as at 56 to permit threaded engagement with the depending pipe flanges. It will thus be seen that the support legs are adjustable into a selected position to establish the height of the device, and the support legs can easily be disassembled from the frame and the leg elements separated from each other for storage or transit.

From the foregoing description it will be seen that a training device for ice skaters has been provided which is constructed so as to be readily assembled or disassembled and which possesses a unique runner structure to assist the skater in developing forward speed from an at rest position.

I claim:

1. A training device for ice skaters comprising:

a rectilinear horizontally disposed frame dimensioned to enclose a skater;

a pair of front support legs and a pair of rear support legs extending downwardly from the corners of said frame;

a runner secured to each of said support legs, the runners on at least said pair of rear support legs being rotatably mounted theron so as to be rotatable through a predetermined arc;

and spring means operatively connecting each of the rotatable runners with their associated support legs, whereby during forward movement of the training device said rotatable runners are caused to rotate against the bias of said spring means into an orientation parallel to the direction of movement and when the training device is at rest said rotatable runners are biased by said springs towards an orientation substantially perpendicular to the longitudinal axis of the training device.

2. A training device according to claim 1, wherein each said rotatable runner is mounted in the associated support leg so as to be rotatable about a vertical axis which is offset from the mid-point of the runner.

3. A training device according to claim 1, including cooperable stop members on each of said rotatable runners and on the associated support legs adapted to engage and thereby limit the extent of rotational movement of said runners.

4. A training device according to claim 1, wherein each of said support legs includes upper and lower telescoping leg elements and means for releasably locking said leg elements in any one of a plurality of positions relative to each other to thereby establish the elevation of said frame.

5. A training device according to claim 4, wherein a depending pipe flange having a threaded lower section is provided on said frame at each corner thereof, each of said upper leg elements being threaded to threadedly engage one of said pipe flanges to thereby secure said support legs to said frame.

6. A training device according to claim 4, wherein said locking means includes a spring loaded locking pin carried by one of said upper and lower leg elements and a series of vertically spaced apertures in the other of said leg elements dimensioned to receive said locking pin.

* * * * *